US007204103B1

(12) United States Patent
Chen

(10) Patent No.: US 7,204,103 B1
(45) Date of Patent: Apr. 17, 2007

(54) FABRIC WINDING MACHINE

(75) Inventor: Shih-Chi Chen, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 11/325,563

(22) Filed: Jan. 5, 2006

(51) Int. Cl.
*D04B 15/88* (2006.01)

(52) U.S. Cl. ..... 66/153

(58) Field of Classification Search ..... 6/150, 6/151, 152, 153
See application file for complete search history.

(56) References Cited

U.S. PATENT DOCUMENTS 3,855,822 A * 12/1974 Lee ..... 66/147
4,932,599 A * 6/1990 Doerfel ..... 242/530.4
5,317,885 A * 6/1994 Vignoni ..... 66/151
5,566,558 A * 10/1996 Tsuchiya ..... 66/151

FOREIGN PATENT DOCUMENTS

TW M245217 U 10/2004

* cited by examiner

*Primary Examiner*—Danny Worrell
(74) *Attorney, Agent, or Firm*—Birch, Stewart, Kolasch & Birch, LLP

(57) ABSTRACT

A fabric winding machine is installed on a circular knitting machine to wind and collect an annular fabric knitted by the circular knitting machine. It has a fabric splitting mode and a fabric non-splitting mode according to the characteristics of the fabric material. The fabric winding machine includes a fabric directing means on which an arched bracket or a fabric extending bracket can be installed respectively corresponding to a fabric splitting mode or a fabric non-splitting mode. The fabric in the two modes can be collected on a fabric collection rod through different fabric winding paths. By switching the two modes the large size fabric winding machine does not have to be disassembled in response to the fabric of different characteristics.

7 Claims, 4 Drawing Sheets

FABRIC WINDING MACHINE

FIELD OF THE INVENTION

The present invention relates to a fabric winding machine and particularly to a fabric winding machine installed on a circular knitting machine to wind and collect finished fabrics.

BACKGROUND OF THE INVENTION

Circular knitting machine is fundamental equipment in the textile industry. It has a plurality of knitting needles located on a needle dial and cylinder to knit same or different types of yarns to become a annular fabric. The knitted fabric is wound by a fabric winding machine located beneath the circular knitting machine to form a bale of neat fabric.

The conventional fabric winding machines include two basic types: one aims to flatten the knitted annular fabric and fold in two halves without splitting the fabric and collect the fabric on a fabric collection bar through a plurality of rollers; another type includes a fabric splitting machine to split the annular fabric, then extend the fabric and wind the extended fabric on the fabric collection rod.

The fabrics knitted from different types of yarns have different fabric characteristics. For instance, the fabric using rubber yarns or including rubber yarns is difficult to return to the original form once folded and pleated. Hence a non-splitting fabric winding machine cannot be used to wind this type of fabric. If a circular knitting machine has originally included such a non-splitting fabric winding machine, the non-splitting fabric winding machine has to be changed to a fabric winding machine equipped with fabric splitting function to avoid forming pleats. However, the fabric winding machine is a large size equipment and quite expensive. Its weight and size make changing difficult on the circular knitting machine. Moreover, to do such a change requires not only disassembly and re-assembly of large equipment, a large storage space also is needed to store the removed fabric winding machine. This seriously affects the cost of producers.

Some techniques have been proposed to remedy the aforesaid problem. For instance, R.O.C. patent No. M245217 entitled "Dual structure for fabric splitting and winding of fabric winding machines" aims to be used for fabric splitting and winding on a knitting machine. It has a fabric splitting machine located on a fabric winding machine that has a splitting knife and a motor. The fabric winding machine is installed on a lower side of the knitting machine and includes guiding wheels, rollers, fabric dispensing wheels, a first and second fabric winding wheels. The fabric splitting machine splits the fabric of the knitting machine. The guiding wheels of the fabric winding machine direct the fabric, the fabric dispensing wheels spread the split fabric, the rollers move the fabric forwards, and finally the first fabric winding wheels wind the fabric. Hence the fabric can be split, spread and wound in a neat manner. When there is no need to split the fabric, the fabric produced from the knitting machine is directly directed by the guiding wheels without passing through the fabric dispensing wheels (by moving the fabric dispensing wheels away); the fabric is wound by the second fabric winding wheels. Thus one machine can achieve two purposes. The main feature of the previous patent is to provide two different winding wheels to wind respectively the split or non-split fabric. The fabric flattening structure is the same. The width of the split fabric is two times of the non-split fabric. Hence it needs an extended space to smooth spreading of the fabric and collect the fabric on the fabric winding wheels.

Moreover, the previous patent has to consider another factor that affects smooth fabric winding in the non-split condition. Namely, in the non-splitting condition the fabric is directly wound through the guiding wheels without any fabric treating. In the event that there is any pleat or wrinkle occurred to the fabric after the knitting operation is finished, the pleat or wrinkle is directed wound into the fabric. This affects the fabric quality.

In addition, the fabric dispensing wheels to spread the split fabric in the previous patent take a lot of space. That patent switches to the non-splitting condition by moving the fabric dispensing wheels backwards. As a result, the space occupied by the fabric winding machine increases, and the number of machines installable on the same size of plant is smaller. Total production output also decreases. This is also a concern to be considered during procurement of the fabric winding machine.

SUMMARY OF THE INVENTION

The primary object of the present invention is to provide a fabric winding machine equipped with dual functions. The fabric winding machine of the invention has a fabric splitting mode and a fabric non-splitting mode that can be switched rapidly according to the fabric material to be knitted by a circular knitting machine. The fabric winding machine includes a fabric directing mechanism to treat the knitted annular fabric finished by the circular knitting machine, and a fabric winding mechanism to collect the fabric on a fabric collection rod. The fabric directing mechanism has an arched bracket or a fabric extending bracket depending on the fabric splitting mode or fabric non-splitting mode. In the fabric splitting mode, a fabric splitting unit is provided to split the annular fabric to become a planar fabric. The two modes mentioned above have different fabric winding paths to wind the fabric on the fabric collection rod. Through the fabric directing mechanism and change of the fabric winding path, the fabric winding machine can provide two types of functions to wind the fabric after split and directly wind the fabric without disassembling and replacing the entire fabric winding machine as the conventional fabric winding machine does.

Another object of the invention is to reduce the space occupied by the fabric winding machine. This invention can be transformed to the fabric splitting mode or non-splitting mode by switching different fabric directing mechanisms. The fabric directing mechanism that is not being used may be removed and stored offsite without occupying an additional operation space.

Yet another object of the invention is to collect the fabric on the fabric collection rod in a smooth and neat manner. In the fabric splitting mode or non-splitting mode, a different fabric directing mechanism and a different fabric collection path are used to treat the fabric. Thereby the fabric can be collected on the fabric collection rod smoothly and neatly.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
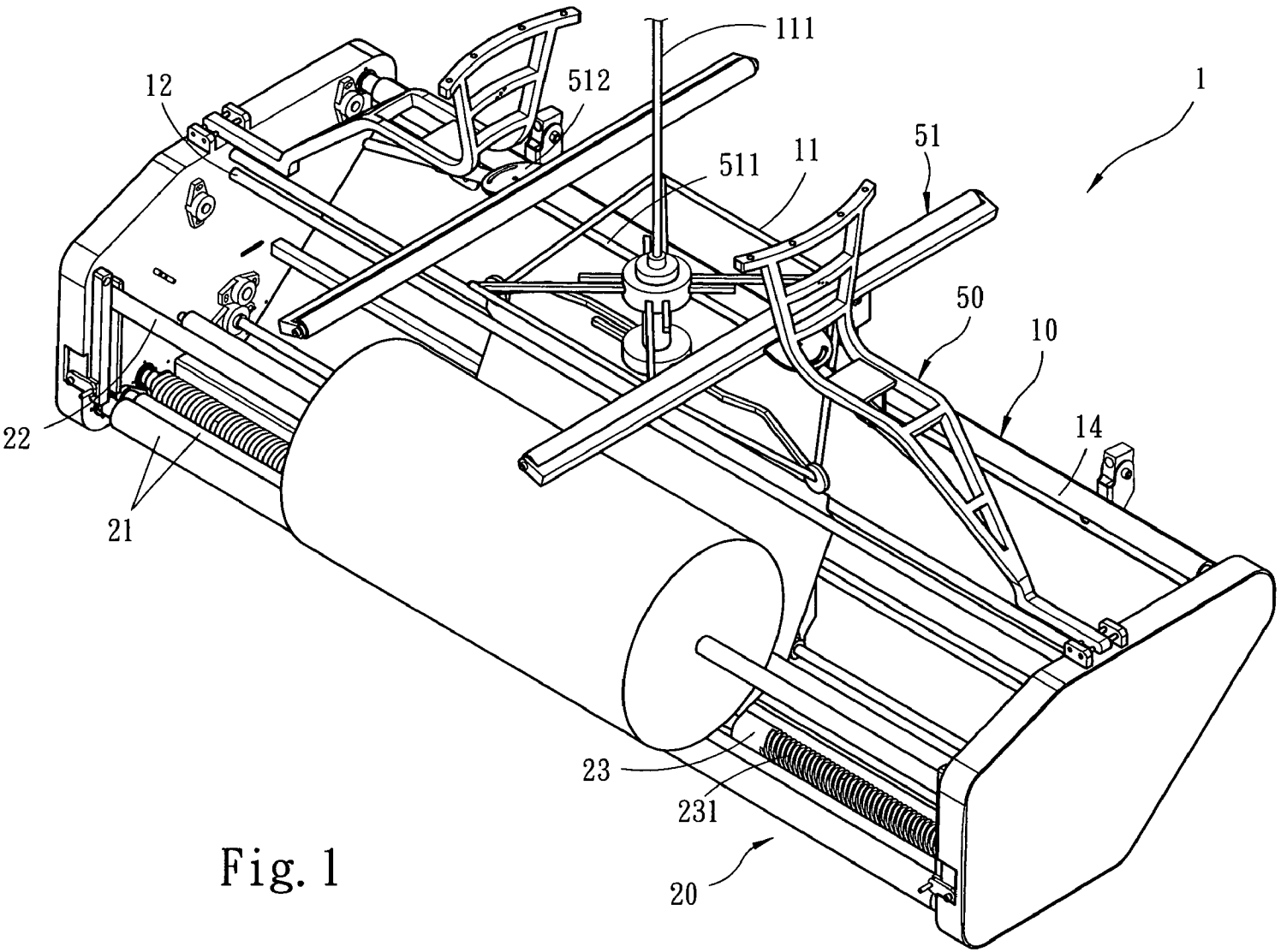
FIG. 1 is a perspective view of the fabric winding machine of the present invention in a fabric non-splitting mode.

Please referring to FIGS. 1 through 4, the fabric winding machine 1 of the invention is installed on a circular knitting machine. The fabric winding machine 1 is coupled on the circular knitting machine (not shown in the drawings) through a transmission bracket 50 which transmits a rotation force to drive the fabric winding machine 1 to rotate synchronously with the needle dial and cylinder (not shown in the drawings) of the circular knitting machine to wind and hold a knitted annular fabric 2 finished by the circular knitting machine. A fabric winding mechanism 20 is driven by a transmission mechanism 30 located on the fabric winding machine 1, and the annular fabric 2 is treated by a fabric directing mechanism 10 of the fabric winding machine 1; then is smoothed by the fabric winding mechanism 20 and collected on a fabric collection rod 22. One type of the fabric directing mechanism 10 can be switched to another type 10' to form a fabric non-splitting mode or a fabric splitting mode with two different paths. In the fabric splitting mode, a fabric splitting unit 40 is added to split the annular fabric 2.

Figure 2:
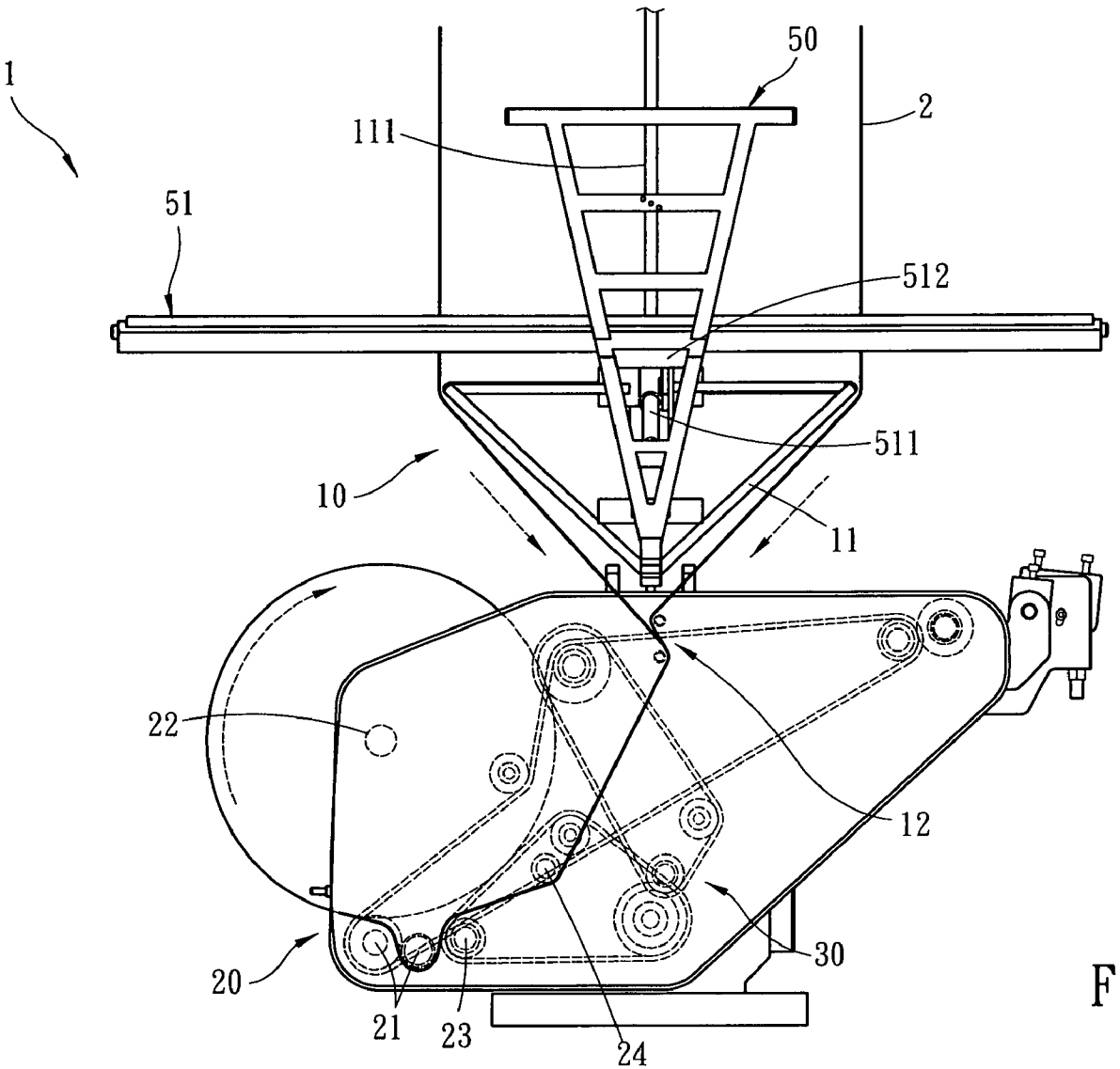
FIG. 2 is a schematic view of the present invention showing the first fabric collection path in the fabric non-splitting mode.

The switching of the fabric directing mechanism 10 has two options. One is the fabric non-splitting mode as shown in FIGS. 1 and 2. In this mode the fabric directing mechanism 10 includes a detachable fabric extending bracket 11 which is fastened to the circular knitting machine through a suspension rod 111 in a detachable manner. Hence while the needle dial and cylinder rotate continuously to knit the annular fabric 2, the annular fabric 2 is held on the fabric extending bracket 11 which stretches the annular fabric 2 to prevent pleats and wrinkles from forming on the fabric surface. The fabric extending bracket 11, fabric winding machine 1 and circular knitting machine rotate synchronously to prevent the annular fabric 2 from being twisted and producing wrinkles caused by the rotational knitting operation of the needle dial and cylinder. The fabric directing mechanism 10 further provides a desired tension to aid two fabric pressing rods 51 of the fabric extending bracket 11 to smooth the annular fabric 2. The fabric pressing rods 51 are fastened to the transmission bracket 50 through a connection rod 511 and a coupling member 512 so that their positions can be adjusted instantly according to the fabric condition to achieve an optimal treating result.

In the fabric non-splitting mode, the fabric directing mechanism 10 of the fabric winding machine 1 has a fabric directing rod assembly 12 located below the fabric extending bracket 11 to fold and stack the annular fabric 2 stretched by the fabric extending bracket 11. The transmission mechanism 30 drives a fabric winding rod 21 of the fabric winding mechanism 20 to wind the folded annular fabric 2 on a fabric expander rod 23 of the fabric winding mechanism 20. The fabric directing rod assembly 12 and the fabric expander rod 23 are interposed by a middle fabric directing rod 24 which presses the annular fabric 2 to provide a tension to keep the flattened annular fabric in a tight condition without generating pleats. The path previously discussed is a first fabric collection path for the fabric non-splitting mode provided by the fabric winding machine 1. The fabric expander rod 23 and two opposite screw threads 231 formed two ends thereof can push any wrinkle generated on the surface of the folding annular fabric 2 to two outer ends. Thus the flattened annular fabric 2 wound on the fabric collection rod 22 is smooth and neat.

Figure 3:
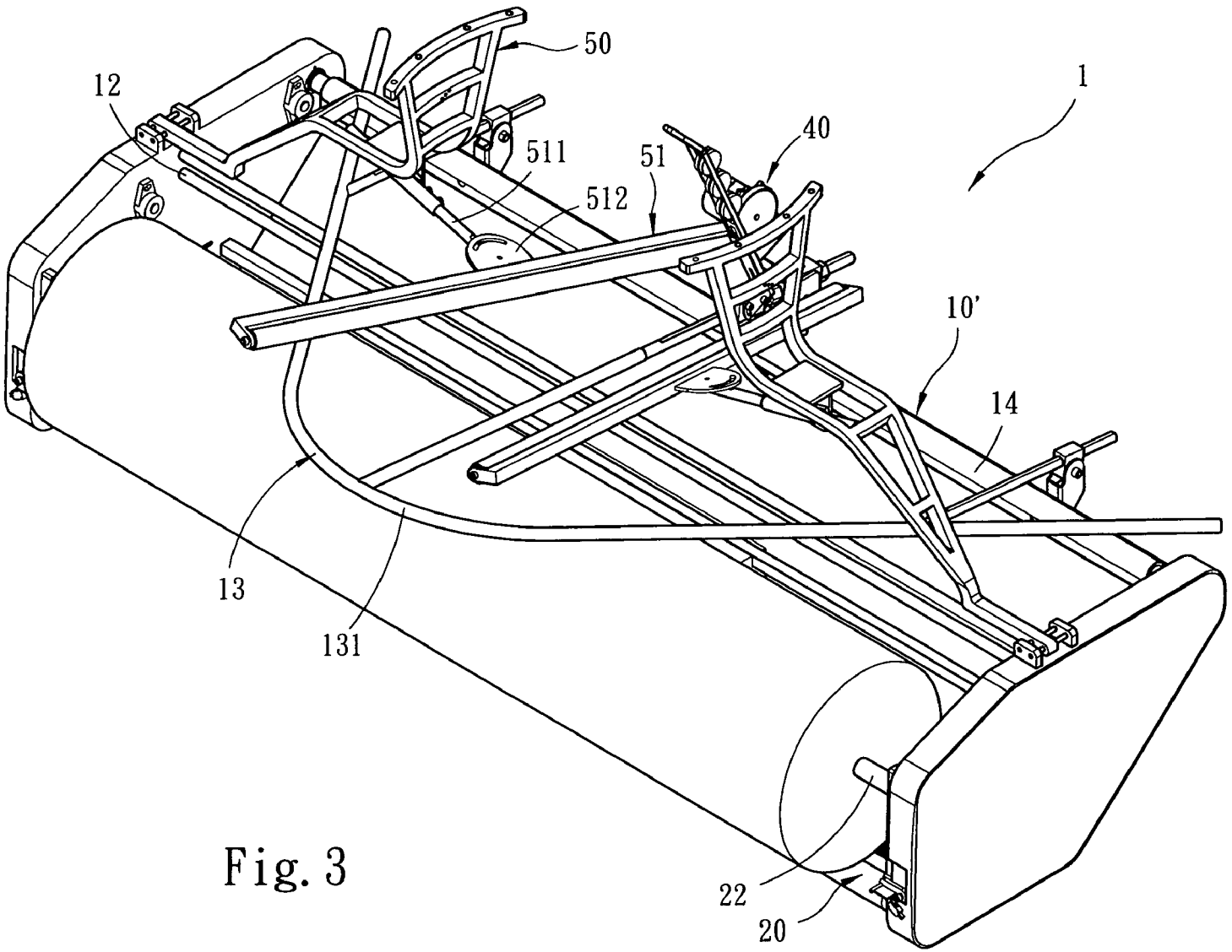
FIG. 3 is a perspective view of the fabric winding machine of the present invention in a fabric splitting mode.
Figure 4:
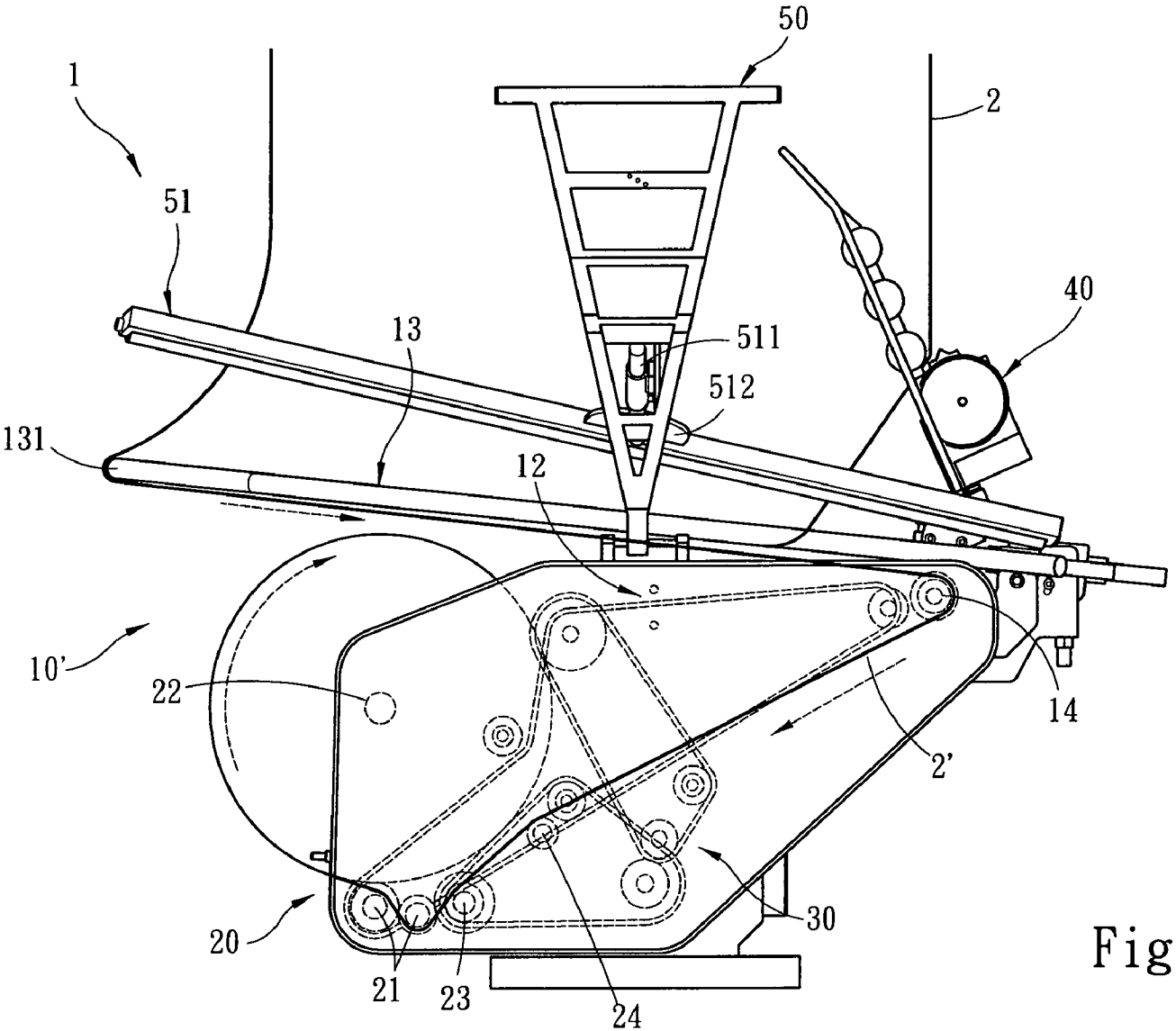
FIG. 4 is a schematic view of the present invention showing the second fabric collection path in the fabric splitting mode.

Referring to FIGS. 3 and 4, in the fabric splitting condition the fabric directing mechanism 10' includes a detachable arched bracket 13 which is fastened to the fabric winding machine 1 in a detachable manner. While the needle dial and cylinder of the circular knitting machine rotate continuously to knit the annular fabric 2, the arched bracket 13 is moved with the transmission bracket 50 to rotate the fabric winding machine 1 synchronously. The fabric winding machine 1 has a fabric splitting unit 40 to split the knitted annular fabric 2 finished by the circular machine to become a planar fabric 2'. The arched bracket 13 has a fabric stretching initial end 131 to stretch the planar fabric 2' to avoid wrinkles or pleats from forming on the fabric surface. The two fabric pressing rods 51 are moved to desired positions to provide a desired tension to aid the arched bracket 13 to press and flatten the planar fabric 2' and provide an optimal smoothing result to facilitate winding and collection.

In the fabric splitting mode, the fabric directing mechanism 10' has a split fabric directing rod 14 located below one end of the arched bracket 13 opposing the fabric stretching initial end 131 on another end. Such a design aims to achieve a purpose: as the split and stretched planar fabric 2' has a much greater width and has to be transformed from annular to planar, during the transformation although the arched bracket 13 is extended, a space is still needed to extend gradually. Otherwise an abrupt change of the shape of the fabric easily produces wrinkles and pleats. Hence the split fabric directing rod 14 is located on a relative far away position from the fabric stretching initial end 131 to allow the planar fabric 2' to have a sufficient space to be transformed to a flattened surface. Then the arched bracket 13 folds and stacks the stretched planar fabric 2'. The transmission mechanism 30 drives the fabric winding rod 21 of the fabric winding mechanism 20 to wind and collect the planar fabric 2' on the fabric expander rod 23 of the fabric winding mechanism 20. Moreover, the split fabric directing rod 14 and the fabric expander rod 23 are interposed by a middle fabric directing rod 24 which presses the planar fabric 2' to provide a tension to make the stretched planar fabric 2' in a tight condition without forming wrinkles. The path discussed above is a second fabric collection path for the fabric splitting mode provided by the fabric winding machine 1. The fabric winding mechanism 20 at the later stage is same as the fabric non-splitting mode, with the fabric expander rod 23 and the two opposite screw threads 231 on two ends thereof to push any wrinkle formed on the surface of the folding planar fabric 2' to the two outer ends. Thus the planar fabric 2' with a smooth surface can be obtained and wound on the fabric collection rod 22.

In summary, the invention aims to provide a fabric winding machine that has detachable fabric directing mechanisms 10 and 10' to form a fabric splitting mode or a fabric non-splitting mode. The annular fabric 2 knitted by the circular knitting machine is operating in a selected mode and guided by the fabric directing mechanism 10 or 10'. Each mode has a different fabric collection path. For the fabric on which pleats are allowable or splitting is not required, the annular fabric 2 knitted by the circular knitting machine follows the first fabric collection path in the non-splitting mode, in which the fabric extending bracket 11 stretches the knitted annular fabric 2 and the fabric directing rod assembly 12 folds and winds the stretched annular fabric 2. For the fabric that does not allow pleats or requires splitting, it is processed by the fabric winding machine 1 in the fabric splitting mode. Switching of the two modes can be accomplished by merely removing the fabric extending bracket 11, and installing the arched bracket 13 and fabric split unit 40. And the annular fabric 2 knitted by the circular knitting machine follows the second fabric collection path, in which the fabric is split by the fabric split unit 40, and held on the arched bracket 13 to be stretched and flattened by the split fabric directing rod 14 to become the flattened planar fabric 2'. Whether the fabric is spitted or not, the fabric winding rod 21 of the fabric winding mechanism 20 is driven by the transmission mechanism 30. The annular fabric 2 or planar fabric 2' is drawn and flattened by the fabric expander rod 23 and wound and collected by the fabric collection rod 22. Hence by means of the fabric winding machine 1 of the invention, switching between the fabric splitting mode and the non-splitting mode can be done easily. And different fabric directing mechanisms can be removed and installed to collect the fabric on the fabric collection rod in a smooth and neat manner. The unused fabric directing mechanism does not occupy operation space or affect production.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A fabric winding machine coupled on a circular knitting machine which knits an annular fabric through two transmission brackets to rotate therewith synchronously comprising a fabric directing mechanism to flatten the annular fabric and a transmission mechanism to drive a fabric winding mechanism to collect the fabric on a fabric collection rod, the fabric winding machine having:

a fabric non-splitting mode in which the fabric directing mechanism includes a detectable fabric extending bracket to stretch the annular fabric and a fabric directing rod assembly located beneath the fabric extending bracket to form a first fabric collection path so that the annular fabric is collected on the fabric collection rod through the first fabric collection path and the fabric winding mechanism; and a fabric splitting mode in which the fabric winding machine includes a fabric splitting unit to split the annular fabric to become a planar fabric and the fabric directing mechanism includes a detectable arched bracket to stretch the planar fabric and a split fabric directing rod to collect the planar fabric stretched by the arched bracket, the arched bracket having a fabric stretching initial end on one end of the fabric winding machine opposing the split fabric directing rod on another thereof to form a second fabric collection path so that the planar fabric is collected on the fabric collection rod through the second fabric collection path and the fabric winding mechanism; and means to switch between the modes wherein the fabric splitting mode or the fabric non-splitting mode is selected and used by the fabric winding machine according to yarn characteristics of the fabric of different materials.

2. The fabric winding machine of claim 1, wherein the fabric directing mechanism includes a fabric pressing rod to flatten the annular fabric in the fabric non-splitting mode or the planar fabric in the fabric splitting mode, the fabric pressing rod being fastened to the at least one of the transmission brackets through a plurality of fastening elements.

3. The fabric winding machine of claim 2, wherein the fabric expander rod has screw threads on two ends thereof to flatten the annular fabric or the planar fabric, the screw threads being formed in opposite directions.

4. The fabric winding machine of claim 1, wherein the fabric winding mechanism in the first fabric collection path and the second fabric collection path includes a fabric expander rod to extend the fabric and two fabric winding rods driven by the transmission mechanism.

5. The fabric winding machine of claim 4, wherein the fabric directing rod assembly and the fabric expander rod of the first fabric collection path are interposed by a middle fabric directing rod.

6. The fabric winding machine of claim 4, wherein the split fabric directing rod and the fabric expander rod of the second fabric collection path are interposed by a middle fabric directing rod.

7. The fabric winding machine of claim 1, wherein the fabric extending bracket is coupled with the circular knitting machine through a suspension rod so that the fabric extending bracket and the circular knitting machine are rotated synchronously.

* * * * *